US007506773B2

(12) United States Patent
Welsch et al.

(10) Patent No.: US 7,506,773 B2
(45) Date of Patent: Mar. 24, 2009

(54) COMPACT, MODULAR STORAGE SYSTEM

(75) Inventors: John H. Welsch, Moscow, PA (US); James J. Janick, Wilkes-Barre, PA (US); Robert J. Welch, Dallas, PA (US); Joseph R. Petcavage, Bear Creek Township, PA (US)

(73) Assignee: Metro Industries, Inc., Reno, NV (US)

( * ) Notice: Subject to any disclaimer, the term of this patent is extended or adjusted under 35 U.S.C. 154(b) by 163 days.

(21) Appl. No.: 11/552,706

(22) Filed: Oct. 25, 2006

(65) Prior Publication Data

US 2007/0063063 A1 Mar. 22, 2007

Related U.S. Application Data

(62) Division of application No. 10/462,598, filed on Jun. 17, 2003, now Pat. No. 7,143,474.

(51) Int. Cl.
*A47F 5/00* (2006.01)

(52) U.S. Cl. ..... 211/162

(58) Field of Classification Search ..... 211/162; 16/94 R, 90–92, 106, 107; 104/107–111; 52/745.2, 29; 312/201; 403/331
See application file for complete search history.

(56) References Cited

U.S. PATENT DOCUMENTS 396,772 A 1/1889 Shreffler, Jr.

(Continued)

OTHER PUBLICATIONS

Denstor—Mobile Store Systems website page, showing Series 700, (Apr. 15, 2003), http://www.denstor.com.

(Continued)

*Primary Examiner*—Sarah Purol
(74) *Attorney, Agent, or Firm*—Fitzpatrick, Cella, Harper & Scinto

(57) ABSTRACT

A shelving system includes at least two parallel lengths of track, at least two pair of end pieces disposed on opposite ends of each of the at least two lengths of track, and a stationary shelving unit attached to one of the at least two pair of end pieces, with the stationary shelving unit including a plurality of posts and a shelf supported by the plurality of posts, and a mobile shelving unit, which includes a plurality of posts, a shelf supported by the plurality of posts, and a plurality of wheels adapted to roll on the at least two lengths of track. Each length of track includes (a) a plurality of track bases, each track base extending between a first base end and a second base end, being formed with a rail channel on a top of the track base and a recess on a bottom of the track base, and including a plurality of elongated holes extending through each of the plurality of track bases, (b) a plurality of track rails, each including a first rail end and a second rail end and being disposed in the rail channel with the first rail end projecting beyond the first base end thereby to define a rail projection and with the second rail end being recessed from the second base end thereby to cause the channel to define a rail projection socket in the track base, and (c) a coupling member disposed in the recess of the track base, the coupling member joining the first base end of one base to the second base end of another base by being fastened through a track base to at least one of the plurality of track rails.

5 Claims, 8 Drawing Sheets

U.S. PATENT DOCUMENTS

| | | | | | |
|---|---|---|---|---|---|
| 701,160 | A | | 5/1902 | Davis | |
| 860,923 | A | | 7/1907 | Lawrence | |
| 2,812,069 | A | * | 11/1957 | Trammell | 211/162 |
| 3,427,085 | A | * | 2/1969 | Staller | 312/200 |
| 3,535,009 | A | * | 10/1970 | Cain | 312/199 |
| 3,801,176 | A | * | 4/1974 | Higbee | 312/199 |
| 3,923,354 | A | * | 12/1975 | Young | 312/201 |
| 3,967,868 | A | * | 7/1976 | Baker, Jr. | 312/201 |
| 3,975,792 | A | | 8/1976 | Janson | |
| 4,597,615 | A | * | 7/1986 | Steger | 312/201 |
| 4,991,725 | A | | 2/1991 | Welsch et al. | |
| 5,072,838 | A | * | 12/1991 | Price et al. | 211/162 |
| 5,205,627 | A | * | 4/1993 | Davison et al. | 312/201 |
| 5,240,213 | A | | 8/1993 | Horcher | |
| 5,265,739 | A | * | 11/1993 | Price et al. | 211/162 |
| 5,341,944 | A | * | 8/1994 | Latino | 211/162 |
| 5,439,281 | A | * | 8/1995 | Croker | 312/201 |
| 5,597,217 | A | * | 1/1997 | Hoska et al. | 312/201 |
| 5,683,155 | A | * | 11/1997 | Sarno | 312/201 |
| 5,907,890 | A | | 6/1999 | Redaelli | |
| 6,112,917 | A | * | 9/2000 | Baker et al. | 211/162 |
| 6,324,988 | B1 | | 12/2001 | Svensson | |
| 6,647,590 | B2 | | 11/2003 | Haab et al. | |
| 6,681,702 | B1 | | 1/2004 | Nicely | |
| 6,726,039 | B2 | * | 4/2004 | Boron | 211/162 |
| 6,776,297 | B2 | * | 8/2004 | Eustace | 211/162 |
| 6,845,721 | B1 | * | 1/2005 | Doucet et al. | 104/173.1 |
| 7,143,474 | B2 | * | 12/2006 | Welsch et al. | 16/94 R |

OTHER PUBLICATIONS

Cari-Stor Systems website page, (Apr. 15, 2003), http://www.cari-all.com.

* cited by examiner

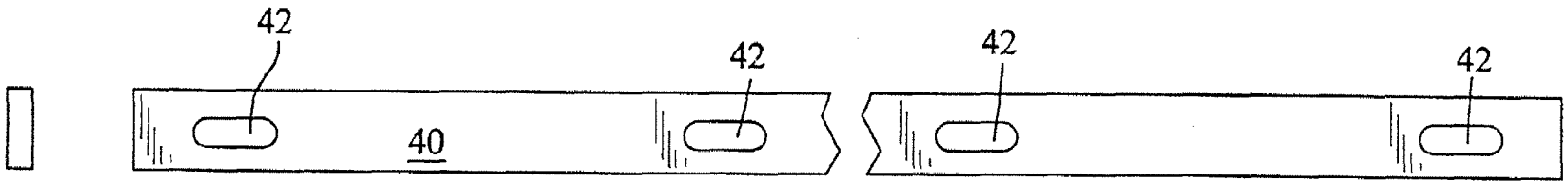
FIG. 7
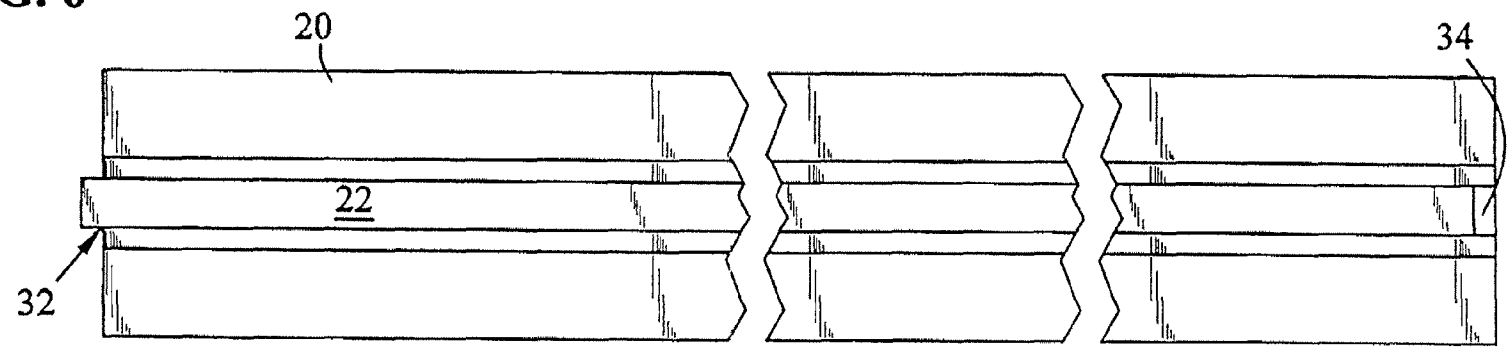
FIG. 6
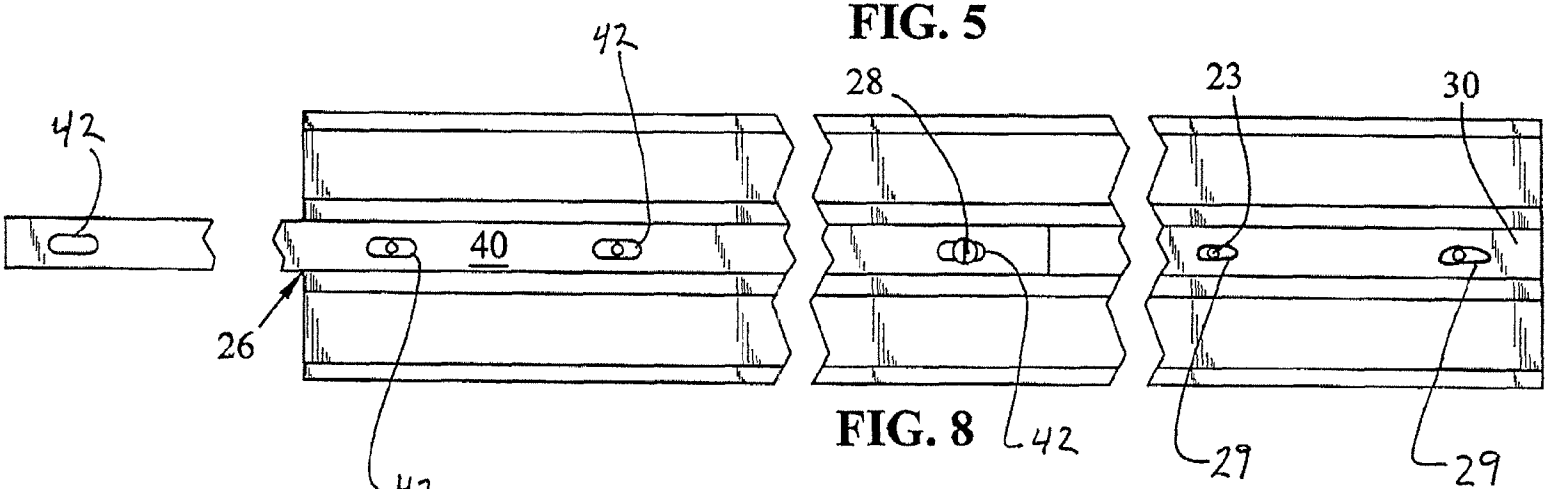
FIG. 5
FIG. 8

COMPACT, MODULAR STORAGE SYSTEM

CROSS-REFERENCE TO RELATED APPLICATIONS

This application is a division of U.S. application Ser. No. 10/462,598, filed Jun. 17, 2003 now U.S. Pat. No. 7,143,474, which is hereby incorporated by reference in its entirety.

BACKGROUND OF THE INVENTION

1. Field of the Invention

The present invention relates to a compact storage system in which a single, movable aisle provides access to a plurality of shelving units.

2. Background Art

Hospitals, restaurants, and other businesses need storage space, but because space is a valuable item, such institutions are in need of devices to maximize storage capacity and minimize building space assigned to storage. To this end, essentially two types of compact storage systems have been developed. The first type of compact storage system uses a movable storage unit that is guided by a track disposed above the movable storage unit and secured on either of its extreme ends by a stationary structure, such as a stationary shelving unit. Such a storage system is disclosed in U.S. Pat. No. 4,991,725, assigned to Metro Industries, Corp. The other type of compact storage system uses a track disposed on the bottom of the movable storage units, and the movable units move by sliding or rolling on the tracks. Such compact storage systems are disclosed in U.S. Pat. Nos. 3,535,009, 3,967,868, 4,597,615, 3,801,176, 6,112,917, and 5,439,281.

These storage systems have shortcomings, however. For example, in certain applications the so-called "top-track" system disclosed in U.S. Pat. No. 4,991,725 may be difficult to move when heavily loaded. Bottom track systems, such as those disclosed in the other patents mentioned above, are often difficult to install. Further, such systems may not be modular, meaning that the tracks come in lengths determined by the manufacturer, rather than the end user.

Accordingly, there is a need in the art for a compact storage system that uses a bottom track and is modular. Such modular, compact storage systems will enable a user to select the length of track desired for any given application.

SUMMARY OF THE INVENTION

According to an aspect of the invention relating to a track system for a rolling apparatus having at least two adjacent track sections, each track section comprises a track base extending between a first base end and a second base end and being formed with a rail channel, a track rail having a first rail end and a second rail end and being disposed in the rail channel, and coupling means. The first rail end projects beyond the first base end thereby to define a rail projection. The second rail end is recessed from the second base end thereby to cause the channel to define a rail projection socket in the track base. The coupling means is (a) for preliminarily coupling adjacent rail sections together with the rail projection of one track section received in the rail projection socket of an adjacent track section and permitting relative movement between the rails and the bases of the adjacent track sections thereby to substantially close any spaces between adjacent bases and between adjacent rails, and (b) for fixedly securing the adjacent rail sections together after any such spaces have been closed.

Another aspect of the invention relates to a method of constructing a track system. The method comprises a first positioning step of positioning a rail on top of a first base and a coupling member on a bottom of the first base, a first attaching step of loosely attaching the coupling member to the rail through the first base such that the first base and the rail are movable relative to each other, a second positioning step of positioning a second base over the coupling member, such that the coupling member extends from the first base to the second base, a second attaching step of loosely attaching the coupling member to the rail through the second base such that the second base and the rail are movable relative to each other, a moving step of moving the first and second bases close together, and a securing step of securing the coupling member to the rail.

Yet another aspect of the invention relates to a shelving system for storage. The shelving system comprises at least two parallel lengths of track, at least two pair of end pieces disposed on opposite ends of each of the at least two lengths of track, and a stationary shelving unit attached to one of the at least two pair of end pieces, with the stationary shelving unit comprising a plurality of posts and a shelf supported by the plurality of posts, and a mobile shelving unit, which comprises a plurality of posts, a shelf supported by the plurality of posts, and a plurality of wheels adapted to roll on the at least two lengths of track. Each length of track comprises (a) a plurality of track bases, each track base extending between a first base end and a second base end, being formed with a rail channel on a top of the track base and a recess on a bottom of the track base, and including a plurality of elongated holes extending through each of the plurality of track bases, (b) a plurality of track rails, each including a first rail end and a second rail end and being disposed in the rail channel with the first rail end projecting beyond the first base end thereby to define a rail projection and with the second rail end being recessed from the second base end thereby to cause the channel to define a rail projection socket in the track base, and (c) a coupling member disposed in the recess of the track base, the coupling member joining the first base end of one base to the second base end of another base by being fastened through a track base to at least one of the plurality of track rails.

BRIEF DESCRIPTION OF THE DRAWINGS

FIG. 5 is a top view of the base and rail;

FIGS. 6 and 7 are side and top views, respectively, of a coupling bar of the track system according to the invention;

FIG. 8 is a bottom view of the coupling bar and the base;

DETAILED DESCRIPTION OF THE INVENTION

Figure 1:
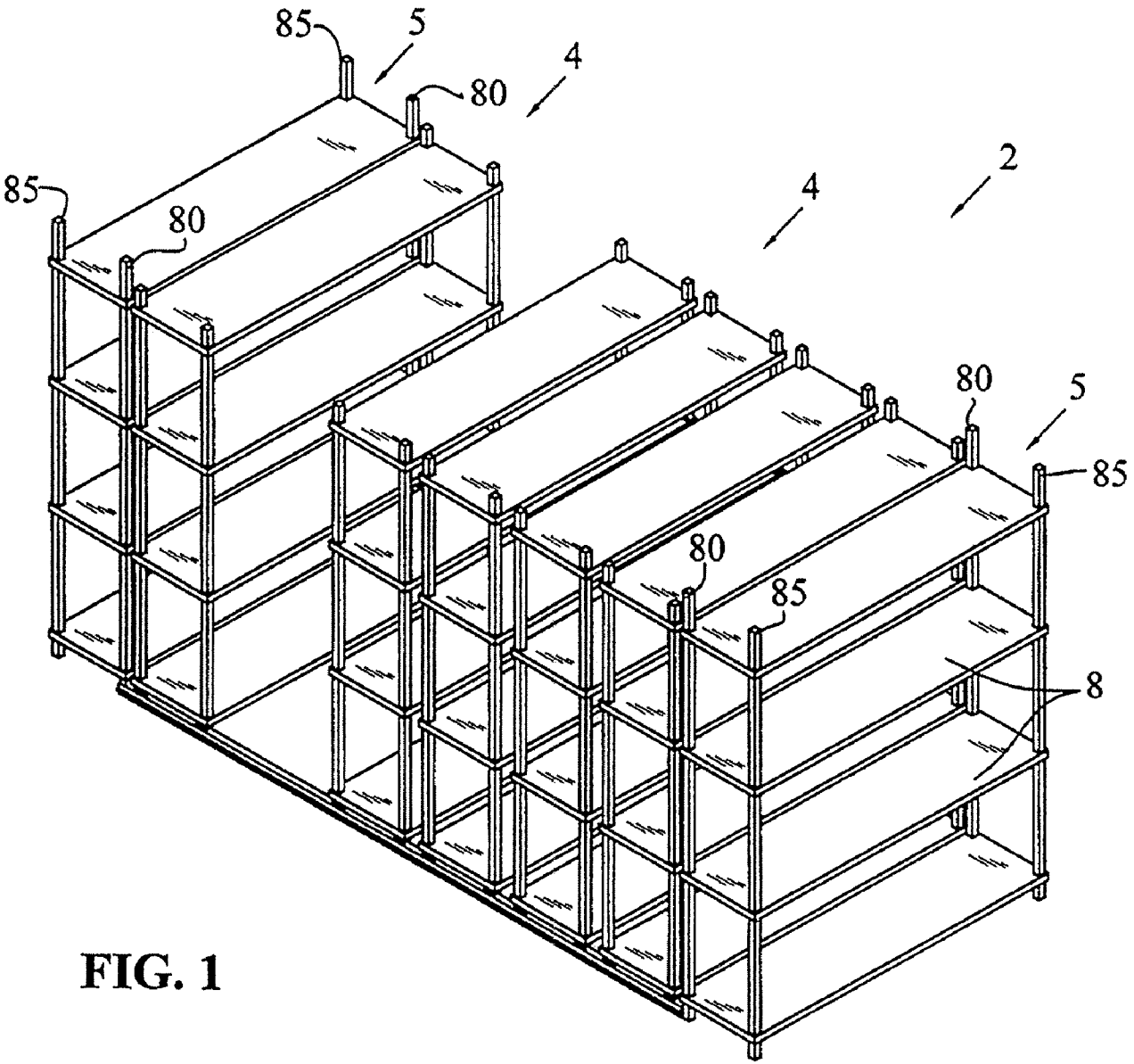
FIG. 1 is a perspective view of a compact storage system according to the present invention.

FIG. 1 shows a compact storage system 2 in which the track system according to the present invention may be used. The storage system 2 comprises a plurality of discrete shelving units 4, each preferably including a plurality of shelves 8 being supported by four posts. Apparatuses for attaching individual shelves 8 to the posts are described, for example, in U.S. Pat. Nos. 3,424,111, 3,757,705, 4,991,725 4,964,350, 5,423,251, 5,279,231, and 5,271,337, each of which is incorporated herein by reference. Of course, the present invention can be adapted for use with units other than shelving units.

As shown in FIG. 1, one or more units 4 are movable on wheels between two extreme stationary units 5. These two stationary units 5 define the lateral boundary for a mobile unit 4. Alternatively, the shelving system 2 may have only one stationary unit 5, in which case the boundary for movement of a mobile unit 4 could be the stationary unit 5 on one side and a wall or other solid structure on the other side. At any rate, the stationary unit 5 may be bolted to the floor, as will be discussed in more detail below, or may be merely held in position by the weight of the contents stored on the shelves 8.

Figure 2:
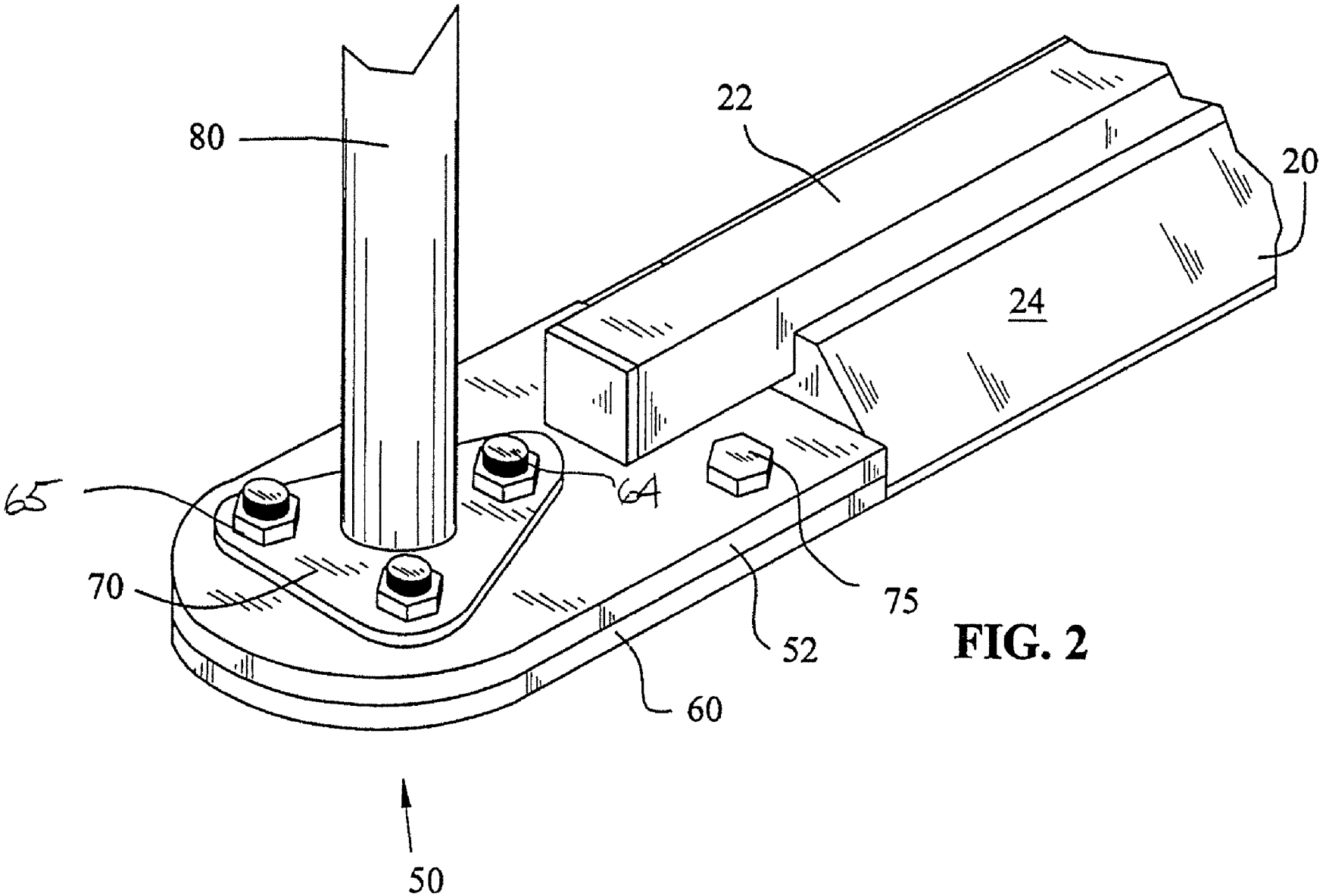
FIG. 2 is a partial perspective view of a track system with an end piece.
Figure 3:
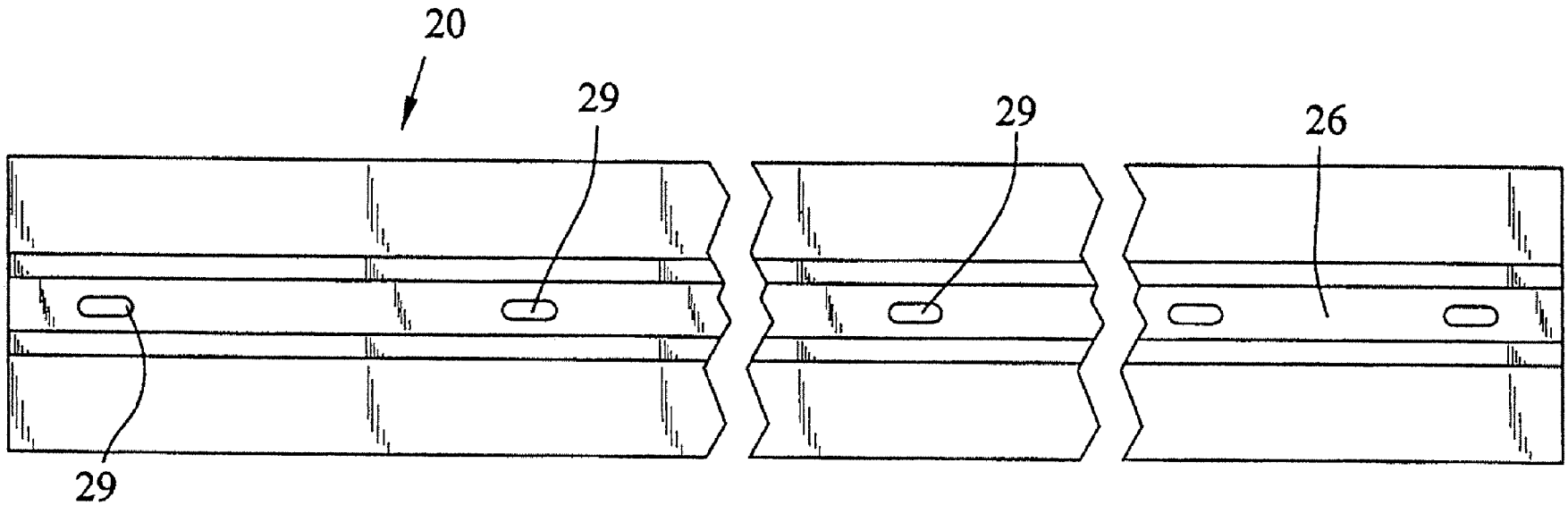
FIG. 3 is a top view of a base of the track system according to the invention.

The mobile unit 4 is movable along a predetermined path between the stationary units 5 by virtue of the track system according to the present invention. The track system comprises a plurality of track sections, each of which includes a base 20 and a rail 22. As shown in FIGS. 2 and 3, the base 20 is preferably an integrally formed member comprising a generally trapezoidal top 24, which includes a groove, or rail channel 26. As shown in FIG. 8, the bottom of the base 20 preferably includes a recess 30, which preferably runs the length of the base 20. However, different types of recesses 30 other than a single recess running the length of the base 20 may be employed in the bottom of the base 20. For example, two recesses 30 may be formed in the bottom of the base 20, with each recess 30 extending inward from an end of the base 20. Regardless, the base 20 further includes a plurality of slots 29 disposed in the recess 30. The slots 29 extend through the base 20.

Figure 4:
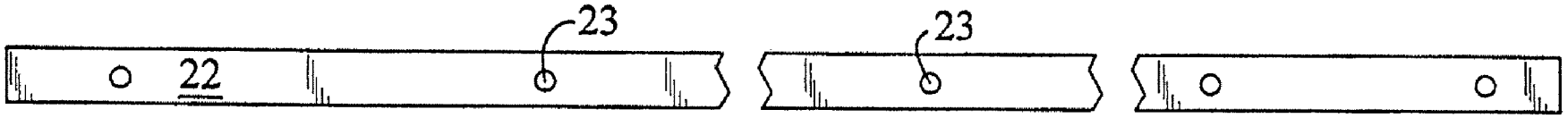
FIG. 4 is a bottom view of a rail of the track system according to the invention.
Figure 9:
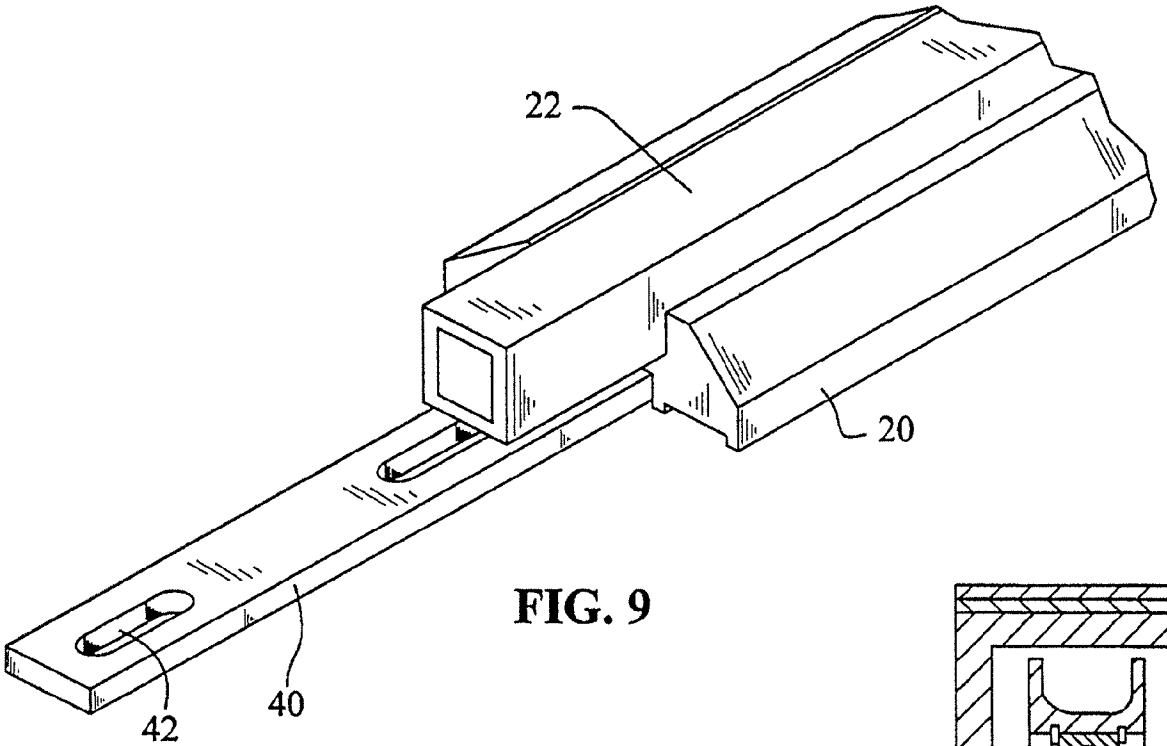
FIG. 9 is a perspective view of a section of the track system according to the invention.

As shown in FIGS. 4 and 9, the rail 22 is preferably a hollow rod or tube having a square cross section. Of course, the rail 22 may be solid, and may even have other cross-sectional shapes, such as circular, ovoid, elliptical or non-square rectangular shapes. Nevertheless, the rail 22 preferably includes a plurality of holes 23 extending through one wall as shown in FIGS. 4 and 9. These holes 23 may be threaded in order to accept a threaded fastener. The holes 23 are formed on the rail 22 so that each hole 23 aligns with a corresponding slot 29 in the base 20. As shown in FIG. 5, when the holes 23 in the rail 22 are aligned with the slots 29 in the base 20, the rail 22 will extend past the base 20 on one end but will be recessed on the other end. By extending beyond the base 20, the rail 22 forms a mating pin 32 (or rail projection), and by terminating before the end of the base 20, the rail 22 forms a mating notch 34 (or rail projection socket).

The base 20 and rail 22 are preferably provided in sections of predetermined length so that an end user can piece together several sections to create a shelving system of a desired size. Each section may be one of two-and-a-half feet, six feet, seven feet or eight feet, although these are mere examples and other lengths for the predetermined sections may be provided. A coupling bar 40, shown in FIGS. 6 and 7, facilitates piecing together sections to form a track system.

Figure 12:
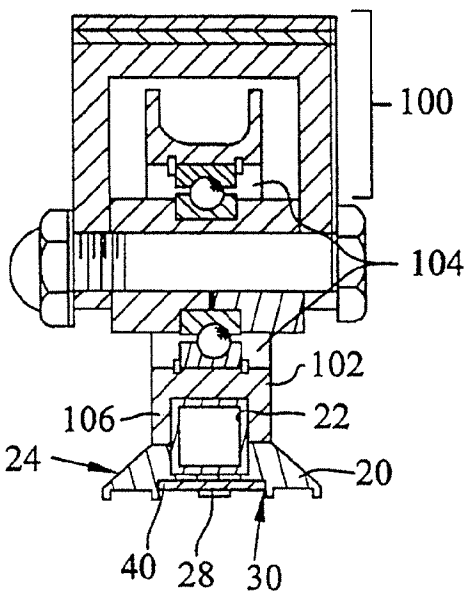
FIG. 12 is a partial cross-sectional view of a wheel rolling on the track system according to the invention.

The coupling bar 40 is preferably a predetermined length that is shorter than a single section of track, and, as shown in FIG. 8, preferably extends just beyond the second of the first two holes from one of the ends of the base 20. However, the coupling bar 40 may also be longer than a single section of track. As shown in FIGS. 5, 9 and 12, the coupling bar 40 is preferably an elongated strip that is thin enough to fit within the recess 30 on the bottom of the base 20 so that the coupling bar 40 and a fastener 28 will not protrude below the bottom of the base 20.

The coupling bar 40 includes a plurality of slots 42. As shown in FIG. 8, the slots 42 are positioned so that they will align with the slots 29 in the base 20, which means the slots 42 will also align with the holes 23 in the rail 22.

All of the track system components are preferably metal. The coupling bar 40 is preferably stainless steel. The rail 22 is preferably roll-formed stainless steel. The base 20 is preferably extruded aluminum, although it may also be stainless steel, a polymer or another material.

To assemble the track according to the present invention, the coupling bar is placed in the recess 30 and the rail 22 is placed in the groove 26 such that the side of the rail 22 having the holes 23 formed therein faces the top surface of the groove 26. The holes 23 in the rail 22 and the slots 42 in the coupling bar are aligned with the slots 29 in the base 20. As shown in FIG. 5, the rail 22 is offset slightly with respect to the base 20 when the holes are aligned, forming the mating pin 32 on one side of the base 20 and the mating notch 34 on an opposite side of the base 20. Meanwhile, the coupling bar 40 protrudes beyond the base 20 and the rail 22. The fastener 28, which may be a self-tapping screw, a conventional screw, a bolt, or a rod and spring clips, can be inserted through the slots 42, 29 in the coupling bar 40 and the base 20 and into the hole 23 in the rail 22. At this point, the fastener 28 is not tightened, so that the base 20, the coupling bar 40 and the rail 22 are loosely connected, forming a first section of track, as shown in FIG. 9. As shown in FIG. 8, two fasteners 28 corresponding to the two end slots 29, 42 and holes 23 can be inserted in this way to loosely hold the coupling bar 40, rail 22 and base 20 together. Additional fasteners 28 may be loosely inserted into one or more middle slots 42*a* and holes 23*a*, although fasteners 28 may be added to these middle slots 42*a* and holes 23*a* later or not at all.

Figure 10:
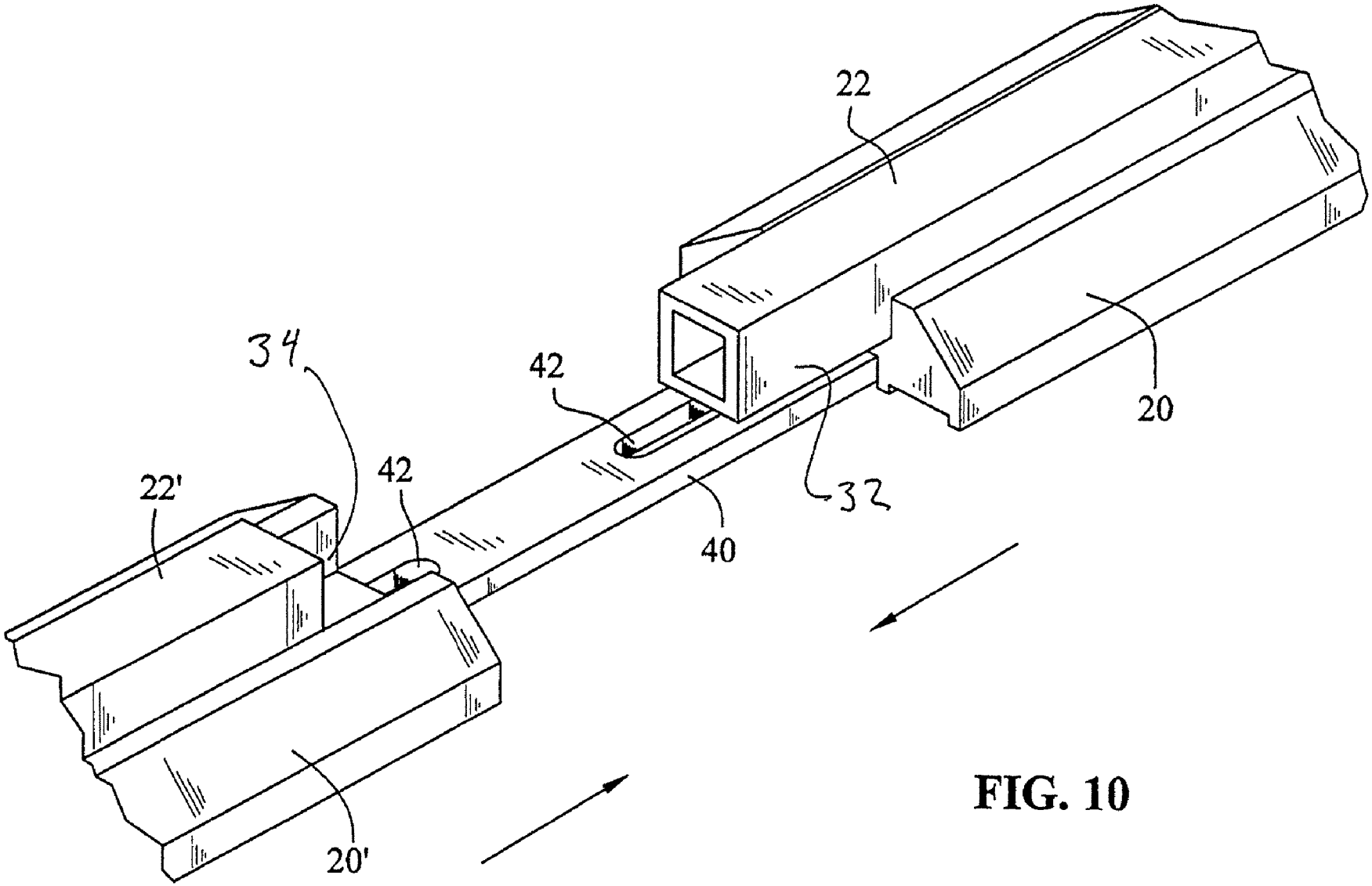
FIG. 10 is a perspective view of two sections of the track system as they are being joined.

To finally assemble the track sections to create a length of track, one loosely assembled track section is brought into alignment with another loosely assembled track section. Referring to FIG. 10, a second base 20' is brought closer to the first base 20 until the two sections of track abut. When abutted, the rail 22 spans the joint between the first base 20 and the second base 20'. The coupling bar 40 will fit in the recess (not shown in FIG. 10) of the second base 20', and the slots 42 in the coupling bar 40 will align with the slots in the second base 20'. A second rail 22', which, as previously described, had been placed in the groove on top of the second base 20' and loosely attached to the second base 20', will abut against the first rail 22 as the first and second bases are brought in contact. In this position, the mating pin 32 enters the mating notch 34 so that the seam between the first and second rails 22, 22' is offset from the seam between the first and second bases 20, 20', ensuring alignment of the track sections.

The two sections of track are then brought into as close abutment with each other as possible to ensure a smooth transition from one section of track to the other. As the sections of track are moved relative to each other, the coupling bar 40 can slide in relation to each section of track because of the elongated holes 42.

When the sections of track are brought to their desired positions relative to each other, the fasteners 28 are tightened, thus securing each section of track to the same coupling bar 40. This coupling-bar arrangement eliminates gaps between sections of track and ensures a smooth transition between sections of track. The coupling bar 40 bridging both sections of track ensures that no relative movement will occur between the first and second sections of track. Additional sections of track can be added to this two-piece section of track in like manner, using additional coupling bars 40 to bridge additional sections of track until a desired length of track is achieved.

Preferably, the components are provided to the consumer loosely assembled as show in FIG. 5, with the rail 22 loosely attached by way of fasteners 28 to the base 20. The rail 22 and base 20 may be loosely assembled by way of fasteners 28 that are loosely connecting the rail 22 and base 20 through the middle slots 29*a* and holes 23*a*. Fasteners 28 may be provided in the end slots 29 and holes 23, but it is not necessary to do so. At any rate, the coupling bar 40 is preferably not attached to the base 20 and rail 22 when provided to the consumer. Rather, the consumer loosely attaches the coupling bar 40 to the base 20, which is already loosely attached to the rail 22, to achieve the arrangement shown in FIG. 9. The subsequent steps for constructing a length of track are the same as previously discussed.

Figure 11:
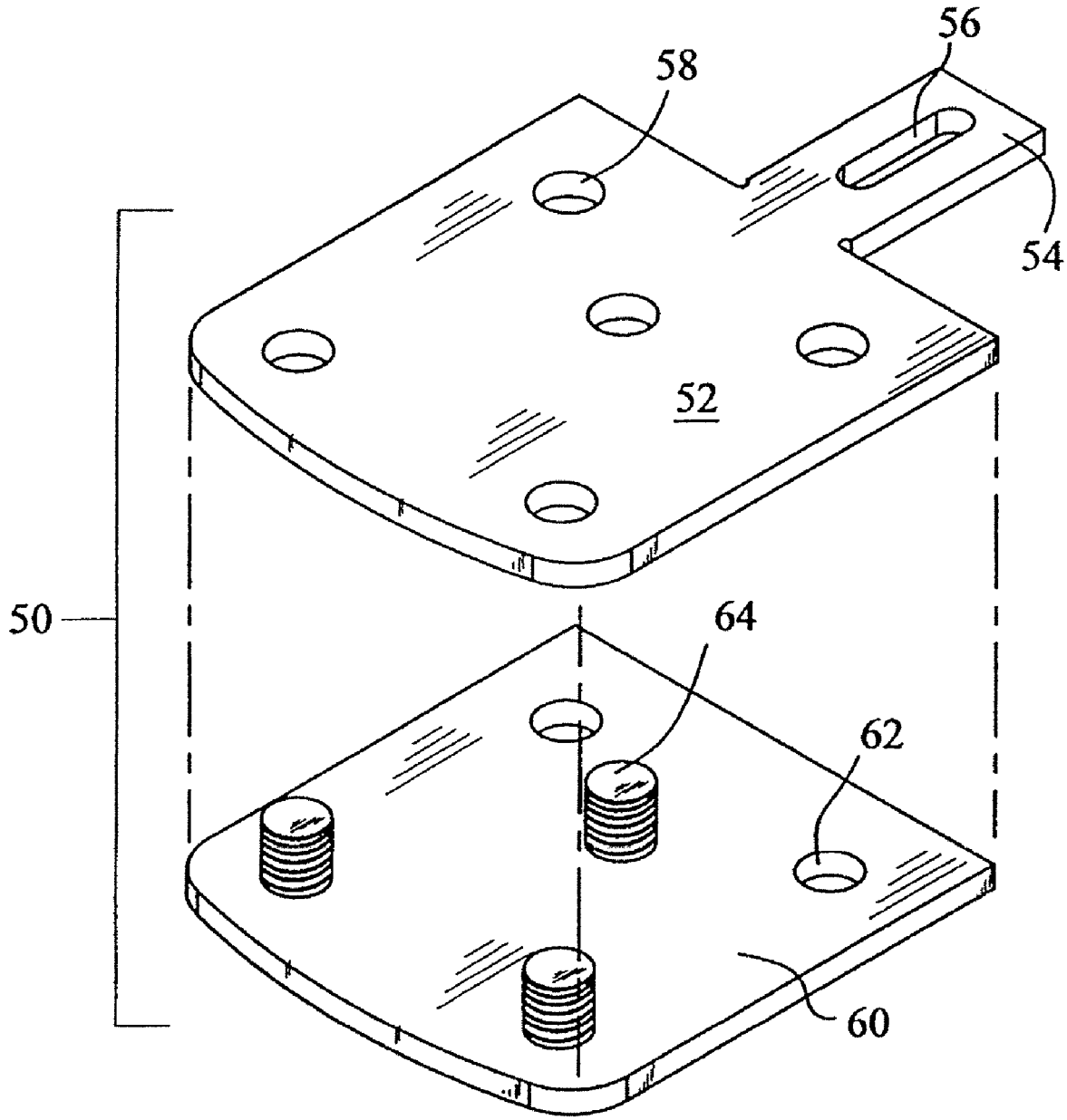
FIG. 11 is an exploded, perspective view of components of an end piece for use with the track system according to the invention.

Although the coupling bar 40 has been described as joining two sections of track together, without deviating from the spirit of the invention the coupling bar 40 may be longer than any single section of track, such that it can join three or more sections of track Once a desired length of track has been pieced together, end pieces 50 are attached to the ends of the length of track. Also, an end cap 25 is preferably inserted into the open end of the rail 22 terminating near the end pieces 50. As shown in FIG. 11, the end piece 50 includes a top plate 52 and a bottom plate 60. The top plate 52 has a tongue 54 with a slot 56 formed therein. The tongue 54 is preferably approximately the same width as the coupling bar 40 or the recess 30 in the bottom of the base 20. The top plate 52 also preferably comprises five apertures 58, two of which align with two apertures 62 in the bottom plate 60. The other three apertures align with three threaded studs 64, which are preferably welded or otherwise joined to the bottom plate 60.

To secure the end pieces 50 to a length of track, the top plate 52 is placed on top of the bottom plate 60. The tongue 54 is inserted in the recess 30 in the bottom of the base 20 so that the slot 56 in the tongue 54 aligns with the slot in the base 20. A fastener 28 is inserted through the tongue 54, the slot in the base 20, and the hole in the rail 22. The fastener 28 is tightened to secure the end piece 50 and the corresponding section of track.

To construct a shelving system 2 as shown in FIG. 1, at least two lengths of track with end pieces 50 attached are placed on the floor in parallel, with a width between them corresponding to the width of a shelving unit 4. The lengths of track may be attached to the floor by way of fasteners 75 extending through the holes 58, 62 in the top and bottom plates of the end pieces 50 and into the floor, shown in FIG. 2. In certain cases, however, it is not necessary to attach the end pieces 50 to the floor, as the weight of one loaded shelving unit 45 may be enough to hold the track system in place. Once the track system is laid out, posts 80 are screwed onto a pedestal 70, secured to the studs 64 by nuts 65.

The pedestal 70 has a threaded stud (not shown) welded to its top. The post 80 may be screwed on to this stud to secure one of the posts 80 composing a stationary shelving unit 5. The shelving unit can also be leveled by this post-threaded stud arrangement.

As shown in FIG. 1, additional posts 85 and shelves 8 can be attached to the posts 80 to form a stationary shelving unit 5. Mobile shelving units 4 having wheels 102 on their bottom are then placed on the two or more lengths of track between the stationary shelving units 5.

FIG. 12 is a partial cross-sectional view showing the wheel assembly of a mobile shelving unit 4 riding on a track section. The wheels 102 on the bottom of these movable shelving units 4 preferably include flanges 106 so that a middle portion of the wheel rests on the rail 22 and the flanges 106 extend from the middle portion on either side of the rail 22. These flanges help prevent the movable shelving unit 4 from moving transverse to the length of the two or more sections of track. The wheels 102 roll on ball bearings.

The wheel 102 is supported in the mobile shelving unit 4 by way of a caster assembly 278. The caster assembly 278 includes a horizontally extending axle 280 spanning the distance between two legs 281 of a horn 282. A base 284 of the horn receives an upwardly projecting rod 286, which is adapted to be frictionally engaged with a socket in the bottom of each corner post of each mobile storage unit 4. The rod 286 includes a C-ring 293, which assists in engaging the caster assembly 278 in the corner posts.

Figure 13:
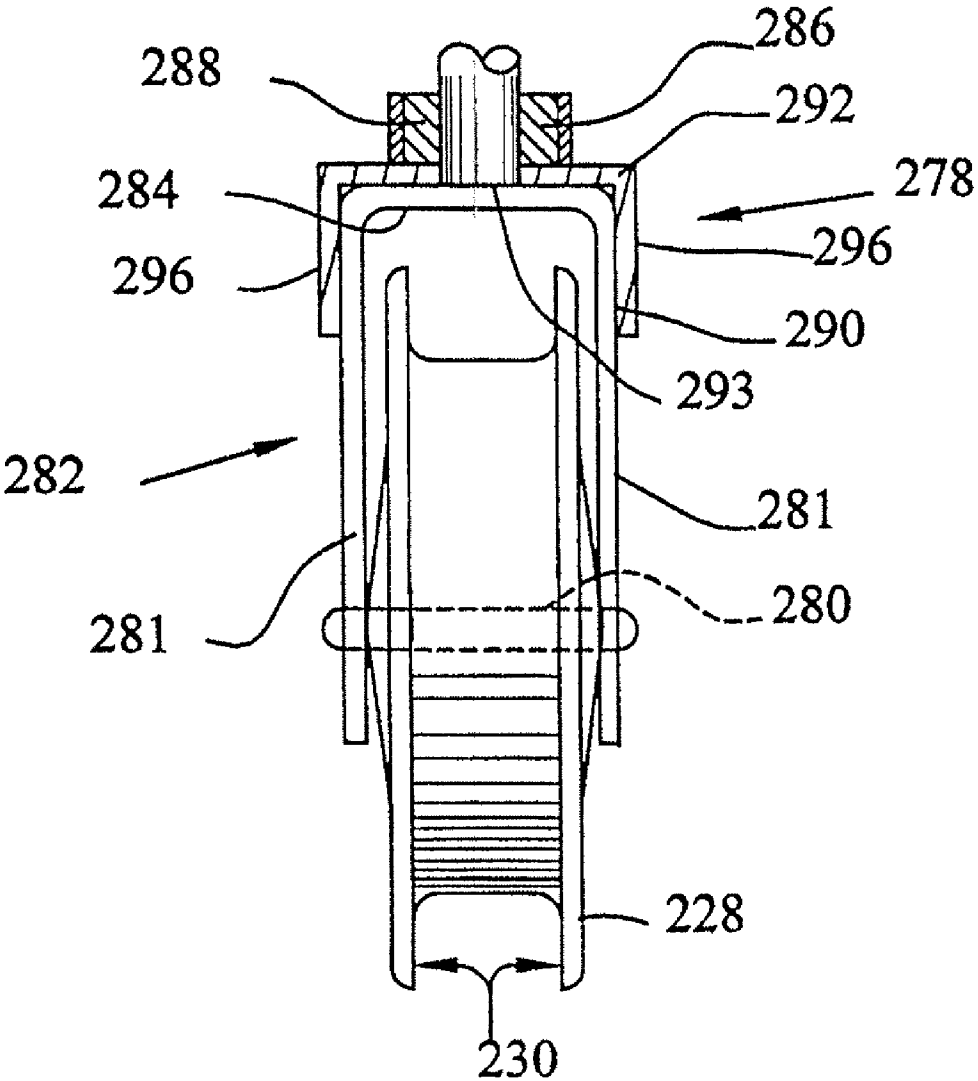
FIG. 13 is a cross-sectional view in perspective of a section of track and posts provided to prevent transverse movement of the section of track.

The present invention can also incorporate structure to prevent transverse movement of the track sections. For example, as shown in FIG. 13, one or more posts 300 in the shape of a cylinder may be attached to the surface supporting the track to project into the base recess 30 between the track ends, thereby to block transverse track movement. (The fasteners 28 are not shown in FIG. 13 for clarity.) The diameter of the posts 300 is preferably as large as the width of the recess 30, and the height is preferably less than the depth of the recess. Although posts having a cylindrical shape have been described, one of ordinary skill will appreciate that the shape of the post is not vital to the spirit of the invention, and the post may take on other shapes, such as a rectangular solid. In addition, the posts are shown in FIG. 13 as being disposed near the middle of the recess 30, but the posts may also be provided nearer the ends of the recess 30. The posts may even be disposed in locations other than the recess 30, such as in contact with an outside edge of the base 20.

The shelving system described above is a compact, modular shelving system. A user can select the length of track to put down by linking more or fewer sections of track together in accordance with best practices for any given room.

In addition to its modular design, the shelving system described above uses a unique system for joining sections of track together. This system uses components having slots that allow relative movement, thus compensating for variations in fit due to manufacturing tolerances.

These advantages are achieved by the invention described herein. However, the true scope of the invention is not limited to the disclosed embodiment. Rather, the present invention covers various modifications and equivalent arrangements included within the spirit and scope of the appended claims. The scope of the appended claims is to be accorded the broadest interpretation so as to encompass all such modifications and equivalent structures and functions.

What is claimed is:

1. A method of constructing a track system, comprising:

a first positioning step of positioning a rail on top of a first base and a coupling member on a bottom of the first base;

a first attaching step of loosely attaching the coupling member to the rail through the first base such that the first base and the rail are movable relative to each other;

a second positioning step of positioning a second base over the coupling member, such that the coupling member extends from the first base to the second base;

a second attaching step of loosely attaching the coupling member to the rail through the second base such that the second base and the rail are movable relative to each other;

a moving step of moving the first and second bases close together; and a securing step of securing the coupling member to the rail.

2. The method according to claim 1, wherein the rail comprises a first rail member and a second rail member, and in said second attaching step the coupling member is attached to the second rail member through the second base, and in said securing step the coupling member is secured to the first and second rail members through the first and second bases, respectively.

3. The method according to claim 2, wherein the coupling member includes at least two holes, each having elongate lateral extent, and the first and second bases each includes a hole having elongate lateral extent and the first and second rail members each includes a hole, and said securing step comprises (a) inserting a fastener through the holes in the coupling member, the first base and the first rail member, (b) inserting a second fastener in another hole of the at least two holes in the coupling member and the holes in the second base and the second rail member, and (c) tightening the fasteners.

4. The method according the claim 1, wherein the first and second bases each include a groove adapted to receive the rail, and said rail positioning step comprises placing the rail in the groove.

5. The method according to claim 1, further comprising an end piece securing step of securing an end piece to an extreme base and securing the end piece to a horizontal surface.

* * * * *